US006386812B2

(12) United States Patent
Garlichs et al.

(10) Patent No.: US 6,386,812 B2
(45) Date of Patent: May 14, 2002

(54) COVER-FEEDER

(75) Inventors: Jurgen Garlichs, Rahden; Dirk Rygol, Osnabruck, both of (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 09/794,462

(22) Filed: Feb. 27, 2001

(30) Foreign Application Priority Data

Mar. 4, 2000 (DE) ..... 100 10 711

(51) Int. Cl.[7] ..... B42C 11/02

(52) U.S. Cl. ..... 412/19; 412/4; 412/24; 198/471.1; 270/52.28

(58) Field of Search ..... 412/4, 13, 19, 412/20, 24; 198/469.1, 470.1, 471.1, 473.1; 270/52.28; 209/152

(56) References Cited

U.S. PATENT DOCUMENTS 4,194,633 A * 3/1980 Paterson et al. ..... 209/152
4,936,563 A * 6/1990 Dubois ..... 271/3
5,192,181 A * 3/1993 Bryde-Hansen ..... 414/795.3
5,316,425 A * 5/1994 Graushar et al. ..... 412/19

FOREIGN PATENT DOCUMENTS

DE PS 6 09 747 1/1935
DE 25 21 849 B1 10/1976

* cited by examiner

*Primary Examiner*—Willmon Fridie, Jr.
(74) *Attorney, Agent, or Firm*—Alix, Yale & Ristas, LLP

(57) ABSTRACT

A cover-feeder for isolating the uppermost cover, in each case, of a flat stack which is continuously advanced, with lateral alignment and as far as a front-edge stop, in an imbricated formation on a transport belt belonging to a feed table, the cover-feeder having a series of separating suction devices belonging to a suction head, which suction head can be pivoted to and fro, for lifting the cover off the stack, and having a drawing-off arrangement for taking over the cover and transferring it to a forwarding conveyor. For the functionally reliable feeding of covers with flaps which are tucked in on one side or with flaps which are tucked in on both sides with enclosed data-carrier disks, the feed table (3) with the transport belt (2) is capable of being positioned obliquely via an adjusting arrangement (13–21), transversely to the direction of drawing-off of the covers (1), in such a way that the elevational line of that face of the covers (1) which is acted upon by the separating suction devices (7) runs parallel to the elevational line of the said separating suction devices (7).

10 Claims, 1 Drawing Sheet

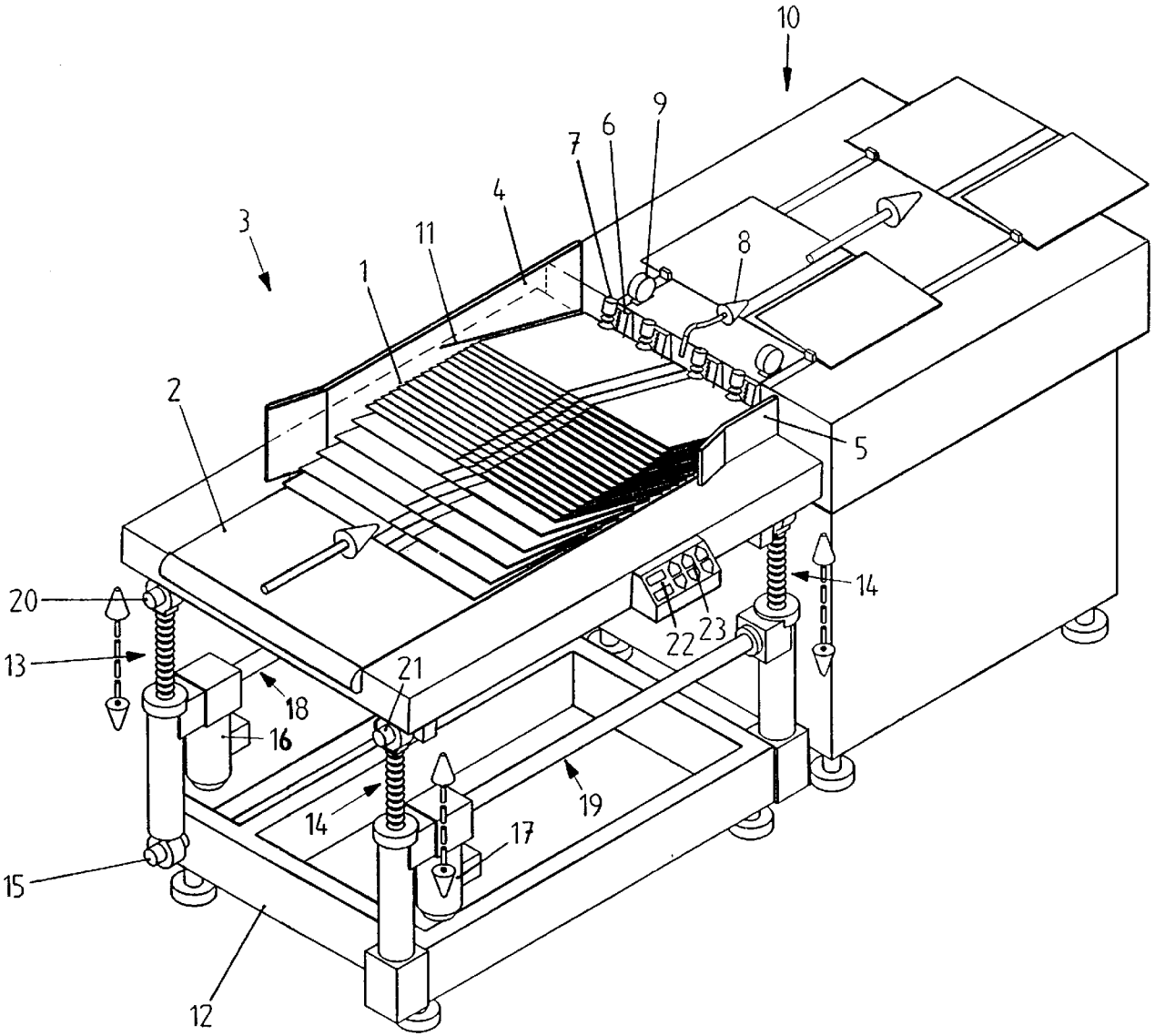
10
9
8
6
7
4
11
1
3
2
5
14
23
22
19
17
21
14
18
16
12
20
13
15

COVER-FEEDER

BACKGROUND OF THE INVENTION

The present invention relates to a cover-feeder for isolating the uppermost cover of a flat stack which is continuously advanced, with lateral alignment and as far as a front-edge stop, in an imbricated formation on a transport belt of a feed table.

In cover stations of adhesive binding machines, cover-feeders are known in which the covers to be isolated are stacked in an imbricated manner and while lying flat on a transport belt belonging to a feed table, and are advanced, with lateral alignment, towards a front stop. In the region of its front edge, the uppermost cover is sucked up in a cyclical manner by a series of separating suction devices of a suction head, lifted off the stack which is set at a specific stack height, and transported onwards as a result of a pivoting movement. Drawing-off rollers take over the cover and feed it to a forwarding conveyor.

Since the separating suction devices used in cover-feeders always alight on the uppermost cover at a defined angle which is constructionally determined, it is necessary to adhere to a specific angle of inclination of the cover to be isolated. A marking system for the angle of inclination may be located on the lateral alignment system of the feed table and corresponds to the degree of imbrication of the covers.

In the case of covers which build up more densely in terms of thickness, either uniformly or non-uniformly over the breadth of the cover, shallower feeding of the imbricated formation is necessary so that the cover to be isolated does not arrive under the suction head at too great a height. This would lead to the separating suction devices no longer alighting on the cover at the predetermined angle, a fact which causes malfunctions.

Although the required angle of inclination of the imbricated item can be set by lifting the feed table with the transport belt on the rear side, functionally reliable isolation of covers having a differing thickness over their breadth caused, for example, by data-carrier disks which have been incorporated or by flaps which have been tucked in on one side, is nevertheless not provided.

In addition, there is a danger that, in the case of covers which are not uniformly thick over their breadth, the imbricated formation will increasingly get into a skewed location and will fall apart towards the side which is no longer supported by lateral guides, a fact which requires constant manual intervention.

SUMMARY OF THE INVENTION

The object of the invention is to provide a cover-feeder of the generic type which guarantees functionally reliable feeding of covers with flaps which are tucked in on one side or with flaps which are tucked in on both sides with an enclosed data-carrier disk, or covers of that kind which build up in a non-uniformly thick manner over their breadth.

This object is achieved by the fact that the feed table with the transport belt can be positioned obliquely via an adjusting arrangement, transversely to the direction of drawing-off of the covers, in such a way that the elevational line of that face of the covers which is acted upon by the separating suction devices runs parallel to the elevational line of the said separating suction devices. Advantageous further developments emerge from the dependent patent claims.

The invention achieves, for the first time, a way of isolating, in a functionally reliable manner, covers which are fed in a cover-feeder in an imbricated formation and have data-carrier disks, such as CD-Roms, incorporated, or covers having flaps which are tucked in on one side. As a result of the oblique positioning of the feed table with the transport belt, transversely to the direction of drawing-off of the covers, it is possible to counterbalance a skewed location of the imbricated formation and thus adhere to a stable location of the said imbricated formation in the course of forward transport to the suction head. What is particularly important for a functionally reliable procedure, however, is optimum adaptation to the contact height of the separating suction devices, which work at a defined elevational level, and also to the stationary front-edge stops by the raising and lowering of the feed table with the transport belt in the oblique position.

BRIEF DESCRIPTION OF THE DRAWING

The invention will be explained in greater detail with the aid of the drawing, in which a cover-feeder with a forwarding conveyor is represented on an exemplary basis and in a perspective view.

DESCRIPTION OF THE PREFERRED EMBODIMENT

The cover-feeder according to the invention for isolating the uppermost cover 1 in each case is intended for use in an adhesive binder. The covers 1 are continuously advanced, with lateral alignment on sheet-metal guides 4, 5 and as far as a front-edge stop 6, as a flat stack in an imbricated formation on a transport belt 2 on feed table 3. In the region of its front edge, the uppermost cover 1 is sucked up by a series of separating suction devices 7 of a suction head, is lifted off the stack and passes between drawing-off rollers 9 in the direction of the arrow 8 as a result of a pivoting movement. The drawing-off rollers draw the cover 1 off the stack and deliver it to a forwarding conveyor 10 which feeds the cover 1 to scoring tools and a cover-pressing station of the adhesive binder.

The degree of imbrication of the covers 1, which results from the inclination of the individual covers and, in particular, of the uppermost cover, must be kept within tight limits for isolation purposes. To this end, a marking system 11 is located on the lateral aligning system 4.

In order to feed, in a functionally reliable manner, covers 1 which build up more densely in terms of thickness, either uniformly or non-uniformly over the breadth of the cover, for example covers 1 with flaps which are tucked in on one side or with flaps which are tucked in on both sides with an enclosed data-carrier disk, the feed table 3 of the cover-feeder with the transport belt 2 can be lifted into an oblique position, viewed in the direction of drawing-off, about a left-hand or right-hand lateral longitudinal arbor 20 or 21, so that the elevational line of that face of the covers 1 which is acted upon by the separating suction devices 7 always runs parallel to the elevational line of the said separating suction devices 7.

Spindle-type adjusting systems 13, 14 are attached, at the corners in each case, to a base frame 12 of the feed table 3, the two spindle-type adjusting systems 13 on the left-hand side being fastened via joints 15 and the spindle-type adjusting systems 14 on the right-hand side being fastened to the base frame 12 in a rigid manner. The feed table 3 is mounted on the spindle-type adjusting systems 13, 14 so as to be rotatable about the lateral longitudinal arbors 20 or 21. Via motor drives 16, 17 with drive couplings 18, 19 in each case for the left-hand spindle-type adjusting systems 13 and right-hand spindle-type adjusting systems 14 respectively, the feed table 3 can be raised or lowered about the lateral longitudinal arbor 21 into an oblique position, on the one hand when there is only one-sided actuation, for example of the left-hand spindle-type adjusting systems 13, by the drive 16 with the drive coupling 18, and on the other hand, the said feed table 3 can be adjusted in height as a whole when there is synchronous actuation of the spindle-type adjusting systems 13, 14.

Scaling systems 22 for the spindle lifts in the vicinity of a control console 23 for the motor drives 16, 17 make it possible to regain a basic position for feeding, in an imbricated formation, covers which build up uniformly over their breadth.

Instead of the motor drives 16, 17 adjusting arrangements which are to be actuated manually are also conceivably possible, with mechanical coupling of the individual spindle-type adjusting systems 13, 14 for synchronous movement.

What is claimed is:

1. In a cover-feeder for isolating the uppermost cover of a flat stack of covers which is continuously advanced, with lateral alignment and as far as a front-edge stop, in an imbricated stack formation on a transport belt of a feed table, the cover-feeder having a series of separating suction devices along an elevational line on a suction head, which suction head can be pivoted to and fro, for lifting the cover off the stack, and having a drawing-off arrangement for taking over the lifted cover and transferring it to a forwarding conveyor, wherein the improvement comprises means for adjusting the feed table with the transport belt to selectable positions obliquely transverse to the direction of drawing-off of the covers, in such a way that the elevational line defined by that face of the cover which is acted upon by the separating suction devices runs parallel to the elevational line of the separating suction devices.

2. Cover-feeder according to claim 1, wherein the feed table with the transport belt can be lifted, about a left-hand or right-hand lateral longitudinal arbor, into an oblique position.

3. Cover-feeder according to claim 1, wherein the feed table with the transport belt is vertically adjustable in the oblique position with respect to the elevational line of the separating suction devices and to a stationary front-edge stop.

4. Cover-feeder according to claim 1, wherein the feed table with the transport belt can be lifted via spindle-type adjusting systems and motor drives with drive couplings.

5. Cover-feeder according to claim 4, comprising a scaling system which indicates the lift of the spindle-type adjusting systems.

6. Cover-feeder according to claim 2, wherein the feed table with the transport belt is vertically adjustable in the oblique position with respect to the elevational line of the separating suction devices and to a stationary front-edge stop.

7. Cover-feeder according to claim 4, wherein the feed table with the transport belt can be lifted, about a left-hand or right-hand lateral longitudinal arbor, into an oblique position.

8. Cover-feeder according to claim 4, wherein the feed table with the transport belt is vertically adjustable in the oblique position with respect to the elevational line of the separating suction devices and to a stationary front-edge stop.

9. Cover-feeder according to claim 7, comprising a scaling system which indicates the lift of the spindle-type adjusting systems.

10. Cover-feeder according to claim 8, comprising a scaling system which indicates the lift of the spindle-type adjusting systems.

* * * * *